US011235228B2

(12) United States Patent
Sasdelli et al.

(10) Patent No.: US 11,235,228 B2
(45) Date of Patent: Feb. 1, 2022

(54) BOARD GAME APPARATUS AND METHOD OF PLAYING THE SAME

(71) Applicant: CMON Productions Limited, Singapore (SG)

(72) Inventors: Renato Sasdelli, São Paulo (BR); Stephen Yee Hung Yau, Kowloon (HK)

(73) Assignee: CMON Productions Limited

( * ) Notice: Subject to any disclaimer, the term of this patent is extended or adjusted under 35 U.S.C. 154(b) by 0 days.

(21) Appl. No.: 16/455,538

(22) Filed: Jun. 27, 2019

(65) Prior Publication Data

US 2020/0001170 A1 Jan. 2, 2020

Related U.S. Application Data

(60) Provisional application No. 62/714,053, filed on Aug. 2, 2018, provisional application No. 62/692,545, filed on Jun. 29, 2018.

(51) Int. Cl.
*A63F 3/00* (2006.01)

(52) U.S. Cl.
CPC ..... *A63F 3/00261* (2013.01); *A63F 3/00634* (2013.01); *A63F 2003/00287* (2013.01); *A63F 2003/00492* (2013.01)

(58) Field of Classification Search
CPC ..... A63F 3/00261; A63F 3/00634; A63F 2003/0028; A63F 2003/0049; A63F 2003/0064; A63F 2003/0026
(Continued)

(56) References Cited

U.S. PATENT DOCUMENTS 1,085,941 A * 2/1914 Russell ..... A63F 3/0695 273/281
1,491,961 A * 4/1924 Miller ..... A63F 5/04 273/142 E
(Continued)

FOREIGN PATENT DOCUMENTS

EP 0 397 065 A1 11/1990
EP 3 178 533 A1 6/2017
(Continued)

OTHER PUBLICATIONS

International Search Report and Written Opinion, PCT/BR2019/050238, dated Jan. 17, 2020.
(Continued)

*Primary Examiner* — John E Simms, Jr.
*Assistant Examiner* — Rayshun K Peng
(74) *Attorney, Agent, or Firm* — Fox Rothschild LLP

(57) ABSTRACT

The board game includes a board game apparatus that is adapted to be placed on a table. The apparatus includes a board and a plurality of chips. The board includes a stand to support the board on the table. The stand is attached to the bottom surface of the board. With the stand, a player can tilt the board in different directions. Before the board is tilted, the board lies flat on the table. A player can tilt the board in a manner such that one side of the board contacts the table surface and another side of the board opposite to that side lifts up from the table surface. The board includes rows of grooves. The chips include a protrusion configured to fit in the grooves and move in the grooves. The chips are configured to slide on the board in response to the tilting movement.

6 Claims, 11 Drawing Sheets

(58) Field of Classification Search
USPC ..... 273/242
See application file for complete search history.

(56) References Cited

U.S. PATENT DOCUMENTS

| | | | | | |
|---|---|---|---|---|---|
| 1,518,178 | A | * | 12/1924 | Chefko | A63F 3/00176 273/263 |
| 1,700,016 | A | * | 1/1929 | Belanger | A63F 3/00574 273/289 |
| 2,174,613 | A | * | 10/1939 | Blaschke | A47B 3/0912 221/199 |
| 2,390,458 | A | * | 12/1945 | Pedersen | A63F 7/0076 273/110 |
| 2,398,726 | A | * | 4/1946 | Seguin | A63F 3/00634 273/108.51 |
| 3,130,972 | A | | 4/1964 | Schwarzlander | |
| 3,409,298 | A | * | 11/1968 | Woods | A63F 7/06 273/108.4 |
| D217,375 | S | * | 4/1970 | Lohr | D21/688 |
| 3,554,553 | A | | 1/1971 | Hayashi | |
| 3,706,455 | A | | 12/1972 | Meyer | |
| 3,727,916 | A | | 4/1973 | Miller | |
| 3,815,917 | A | | 6/1974 | Brown | |
| 3,931,972 | A | | 1/1976 | Fabian | |
| 4,034,985 | A | * | 7/1977 | Breslow | A63F 7/0023 273/110 |
| 4,052,068 | A | * | 10/1977 | Piacentino | A63F 7/0017 273/122 R |
| 4,076,243 | A | * | 2/1978 | Davis | A63F 7/06 273/108.55 |
| 4,094,507 | A | * | 6/1978 | Kauffmann | A63F 7/386 273/110 |
| 4,470,601 | A | * | 9/1984 | Finn | A63F 9/0803 273/153 S |
| 4,589,664 | A | * | 5/1986 | Slimp, Jr. | A63F 9/26 273/258 |
| 4,886,278 | A | | 12/1989 | Salter et al. | |
| 5,203,279 | A | | 4/1993 | Eversdyk | |
| 5,333,877 | A | | 8/1994 | Pridgeon et al. | |
| 5,558,336 | A | | 9/1996 | Sapello | |
| 5,687,970 | A | * | 11/1997 | Clark | A63F 3/00634 273/153 S |
| 6,485,017 | B1 | | 11/2002 | Ng | |
| 6,749,196 | B2 | * | 6/2004 | Serlachius | A63F 7/0684 273/108.51 |
| 8,403,328 | B2 | | 3/2013 | Vandoren | |
| 2006/0255545 | A1 | * | 11/2006 | Giglia | A63F 9/26 273/449 |

FOREIGN PATENT DOCUMENTS

| | | | |
|---|---|---|---|
| FR | 423 593 | A | 4/1911 |
| GB | 2 240 725 | A | 8/1991 |
| GB | 2 274 598 | A | 8/1994 |
| GB | 2 427 829 | A | 1/2007 |

OTHER PUBLICATIONS

Written Opinion and International Preliminary Examining Authority (IPEA), PCT/BR2019/050238, dated Sep. 24, 2020.

* cited by examiner

BOARD GAME APPARATUS AND METHOD OF PLAYING THE SAME

CROSS-REFERENCE TO RELATED APPLICATIONS

This application claims the benefit of U.S. Provisional Application 62/692,545, filed Jun. 29, 2018 and U.S. Provisional Application 62/714,053, filed Aug. 2, 2018. Each of the foregoing applications is expressly incorporated by reference herein.

FIELD OF THE INVENTION

The present invention relates to apparatuses and methods of operating the apparatuses that can applicable to games, and more particularly to an apparatus including a board having a series of intersecting grooves, a plurality of playing pieces movable in the grooves, and a stand or legs configured to support and tilt the board in predisposition directions.

BACKGROUND OF THE INVENTION

Apparatuses applicable to games are well known and widely used for entertainment and educational and purposes. One type of such apparatuses include tilting boards. Although there is a large number of apparatuses that involve maintaining of the equilibrium of the board or causing the board to tilt as part of operating (or playing) the apparatus, such apparatuses have not gained general popularity. Accordingly, there remains a need for a novel apparatus having a titling board or a combination of such apparatus and a method of operating the apparatus which has much greater public acceptance than any prior art apparatuses applicable to games.

SUMMARY OF THE INVENTION

In accordance with principles of the invention, a board apparatus, board game apparatus, or apparatus applicable to games is contemplated. The apparatus comprises a rectangular board having a top and bottom surface and a stand attached to the bottom surface. The top surface includes horizontal and vertical rows of grooves and the stand is configured to support the board on a flat surface in a horizontal position. The apparatus also comprises a plurality of chips with each including a protrusion configured to fit in the grooves. The chips are configured to move in the grooves via the protrusion and in directions determined by the grooves. The stand is configured to make the board movable between the horizontal position and a number of tilted positions defined by the stand. The board in each tilted position allows chips to slide on the board due to force of gravity. The stand defines four tilted positions, and the board has four sides and is configured to move to each tilted position by applying force to or lifting a corresponding side of the four sides. The top surface is formed without a hole that allows chips on the board to fall toward the flat surface or into the stand. The board further includes a border that prevents chips from falling off the top surface and that is formed without entry points through which chips can be inserted.

In one embodiment, the stand includes a plurality of legs. Each of the legs is positioned directly under each corner of the board or in an area close to each corner of the board. Each of the legs includes a first region supporting the board on the flat surface in the horizontal position. Each of the legs also includes a second region supporting the board in the tilted position. Each of the legs further includes a sloped side extending from the first region to the second region. The second region has a structure requiring force being applied to the board in order to hold the board in the tilted position.

The stand is configured to return the board to the horizontal position when force is stopped being applied to or upon releasing the corresponding side of the four sides.

the border includes a board lifting area allowing a player to move the board from the horizontal position to one of the tilted positions.

In accordance with principles of the invention, another board apparatus, board game apparatus, or apparatus applicable to games is contemplated. The apparatus comprises a rectangular board having a top and bottom surface and a stand attached to the bottom surface. The top surface includes horizontal and vertical rows of grooves and the stand is configured to support the board on a flat surface in a horizontal position. The stand is configured to make the board movable between the horizontal position and a number of tilted positions defined by the stand. The stand defines four tilted positions, and the board has four sides and is configured to move to each tilted position by applying force to or lifting a corresponding side of the four sides. The top surface includes the horizontal and vertical rows of grooves is a continuous, unbroken surface.

The apparatus further comprises a plurality of chips and each chip includes a protrusion configured to fit in the grooves. The chips are configured to move in the grooves via, the protrusion and in directions determined by the grooves.

The board in each tilted position allows the chips to slide on the board due to force of gravity.

The board includes a border that prevents the chips from falling off the top surface.

In one embodiment, the stand includes a plurality of legs. Each of the legs is positioned directly under each corner of the board or in an area close to each corner of the board. Each of the legs includes a first region supporting the board on the flat surface in the horizontal position. Each of the legs also includes a second region supporting the board in the tilted position. Each of the legs further includes a sloped side extending from the first region to the second region. The second region has a structure requiring force being applied to the board in order to hold the board in the tilted position.

The stand is configured to return the board to the horizontal position when force is stopped being applied to or upon releasing the corresponding side of the four sides.

In accordance with principles of the invention, yet another board apparatus, board game apparatus, or apparatus applicable to games is contemplated. The apparatus comprises a rectangular board having a top and bottom surface and a foldable stand attached to the bottom surface. The top surface includes horizontal and vertical rows of grooves and the board is configured to be placed on a flat surface with the stand unfolded. The apparatus also comprises a plurality of chips with each including a protrusion to fit in the grooves. The chips are configured to move in the grooves via the protrusion and in directions determined by the grooves. The stand allows the board to be tilted in a direction and the tilted board allows chips on the board to slide in the tilted direction due to force of gravity. The rectangular board is adapted to be tilted in only four directions with each direction corresponding to each side of the rectangular board. The rectangular board is formed without a hole that allows chips on the board to be dropped toward the flat surface or into the stand.

The rectangular board further includes a border that prevents chips from falling off the top surface and that is formed without entry points through which chips can be inserted.

In accordance with principles of the invention, yet another board apparatus, board game apparatus, or apparatus applicable to games is contemplated. The apparatus comprises a rectangular board having a top and bottom surface and a stand attached to the bottom surface. The top surface includes horizontal and vertical rows of grooves and the board is configured to be placed on a flat surface with the stand. The stand allows the board to be tilted in a direction and the tilted board allows chips on the board to slide in the tilted direction due to force of gravity. The rectangular board is adapted to be tilted in only preconfigured directions adapted to be provided by the structure of the stand and board arranged together. The rectangular board has a continuous surface that includes the grooves and structures that form the grooves. The rectangular board further includes a border that prevents chips from falling off the top surface.

The apparatus further comprises a plurality of chips with each including a protrusion to fit in the grooves. The chips are configured to move in the grooves via the protrusion and in directions determined by the grooves.

The board is without a hole that can receive a chip.

Counterpart method embodiments would be understood from the above and the overall disclosure. Also, broader, narrower, or different combinations of the described features are contemplated, such that, for example, features can be removed or added in a broader or narrower way.

BRIEF DESCRIPTION OF THE DRAWINGS

FIG. 10*a* depicts another side view of the board in which part of the top surface, part of the legs, and a board lifting area are also shown whereas

Figure 1B:
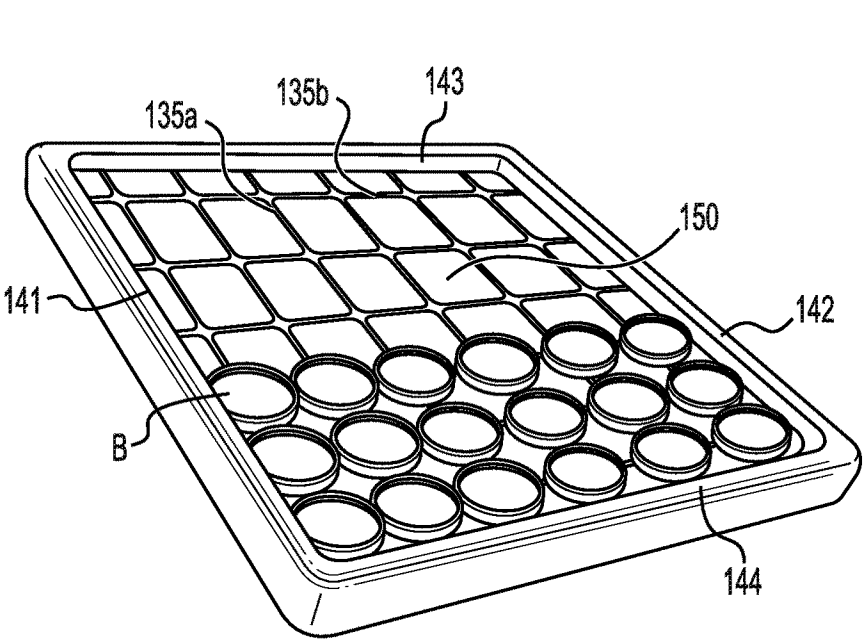
FIGS. 1*a*-1*b* depict a top view of an illustrative board game apparatus showing the movement of the chips in accordance with some embodiments of the invention.

The components in the figures are not necessarily drawn to scale, emphasis instead being placed upon illustrating the principles of the invention. Moreover, in the figures, like reference numerals designate corresponding parts throughout the different views. However, like parts do not always have like reference numerals. Moreover, all illustrations are intended to convey concepts, where relative sizes, shapes and other detailed attributes may be illustrated schematically rather than literally or precisely.

DETAILED DESCRIPTION OF THE INVENTION

Figure 1A:
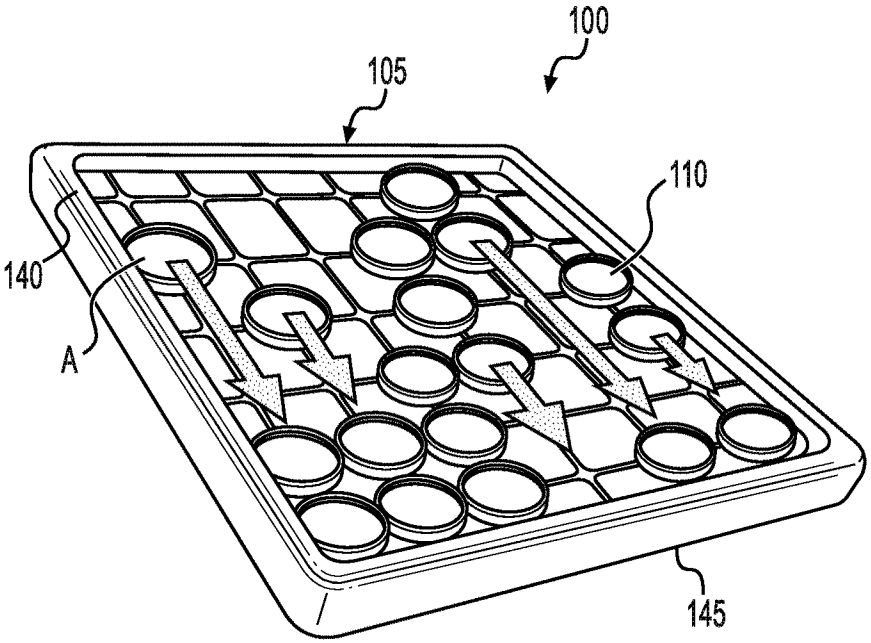
Figure 2C:
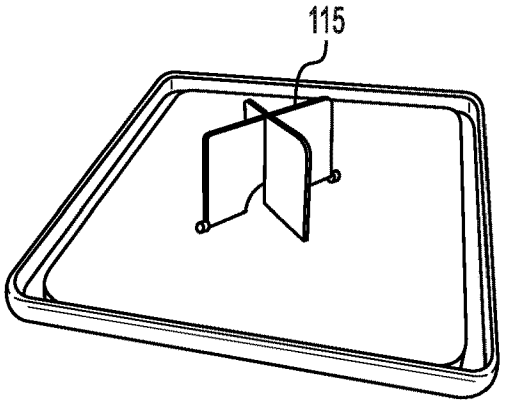
FIGS. 2*a*-2*c* depict a bottom view of the board game apparatus in FIGS. 1*a*-1*b* showing an illustrative stand in accordance with some embodiments of the invention.
Figure 2B:
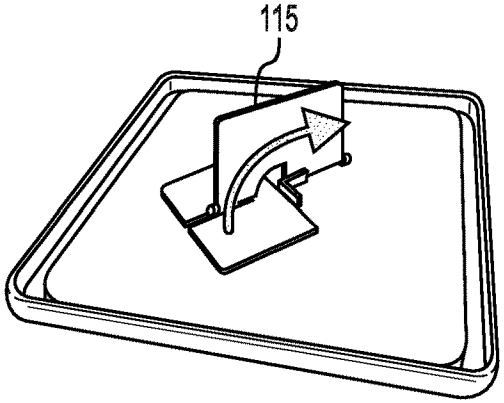
Figure 2A:
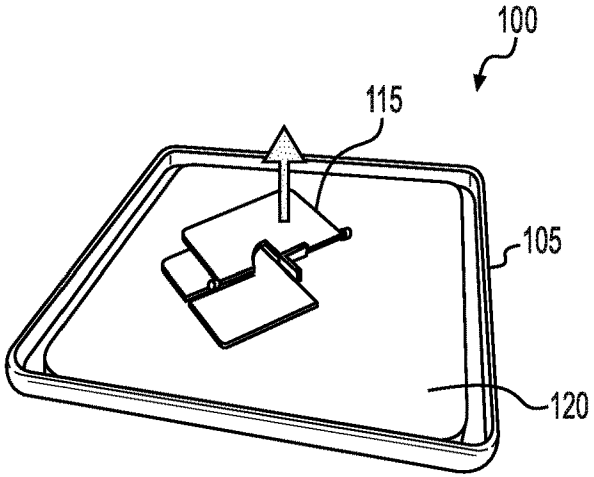

FIGS. 1-11 depict illustrative apparatuses and methods applicable to games in accordance with some embodiments of the present invention. Features of the illustrative structures, apparatuses, methods are described and are evident from the figures submitted with this application. According to embodiments of the invention, new apparatuses and methods applicable to games are provided. For convenience, the term board game is used but it is understood that it refers to an apparatus or method applicable to games, or a board game apparatus or method. The board game includes a board game apparatus that is adapted to be placed on a table or other flat surface. FIGS. 1-3 depict an illustrative board game apparatus 100. The apparatus 100 includes a board 105 and a plurality of chips 110. The board 100 includes a stand 115 (FIGS. 2*a*-2*c*) to support the board 105 on the table or other surface. The stand 115 is attached to the bottom surface 120 of the board 105. With the stand 115, a player can tilt the board 105 at different directions (FIGS. 3*a*-3*e*). Before the board 105 is tilted, the board may lie flat on the table or be positioned parallel to the table surface. In one embodiment, the board has a square shape. A player can tilt or place the board 105 on the table with one side 125 of the board 105 contacting the surface of the table and another side 130 of the board 105 opposite (or parallel) to that side lifting further away from the surface of the table. Other shapes of the board are also contemplated. In this embodiment, the stand 115 is foldable (FIGS. 2*a*-2*c*). The stand 115 can be folded for minimizing the size of the apparatus 100 and for storing or carrying the apparatus 100 when the apparatus 100 is not played. The apparatus 100 is placed on the table with the stand 115 unfolded so that the stand 115 can support the board 105 above on the table in a stable position (FIG. 3*a*). A player can push one side of the board 105 toward the surface of the table to tilt the board 105 (FIGS. 3*b*-3*e*).

Figure 3C:
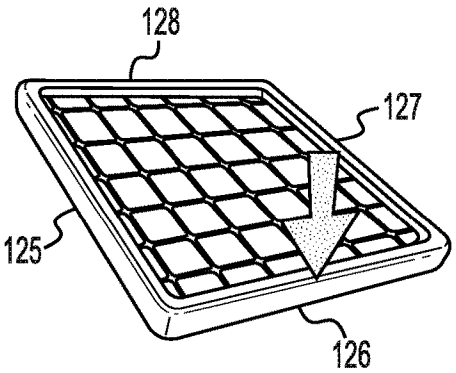
FIGS. 3*a*-3*e* depict an illustrative board game apparatus tilting in different directions in accordance with some embodiments of the invention.
Figure 3B:
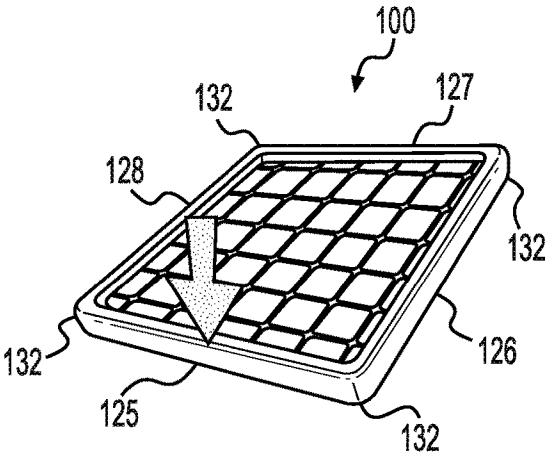
Figure 3A:
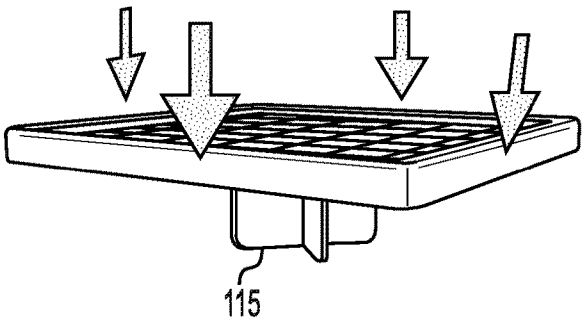
Figure 3E:
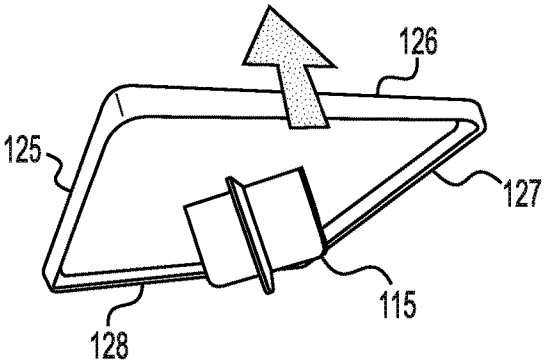
Figure 3D:
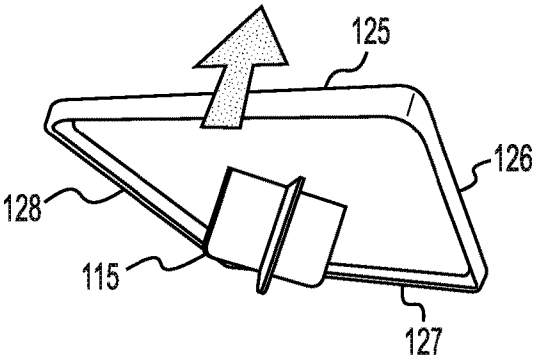

Preferably, as shown in FIGS. 3*b*-3*e*, the board and stand are configured in a way such that the board can be tilted in only four directions, with each direction corresponding to each side of the square or rectangular board. For example, the board is configured to tilt only on the bottom side 125 (FIG. 3*b*), right side 126 (FIG. 3*c*), top side 127 (FIG. 127), and left side 128 (FIG. 3*e*) of the board. When the board has a square shape, the left side, right side, top side, and bottom side refers to the four equal sides (that have equal length) of the board, and any two of the adjacent sides form a right angle. When the board has a rectangular shape, the left side and the right side may have the same length, the top side and the bottom side have the same length, and any two of the adjacent sides form a right angle. In one embodiment, the board cannot be tilted at a corner 132 or be supported on the surface via a corner 132 of the board. For example, when a player attempts to place the board on the table using a corner 132 of the board as a supporting point, the board would move or rotate to either side of the corner 132 and contact the table via that side. When the board is tilted on one side, pressing or pushing a corner of the board may tilt the board in another direction corresponding to another side of the board. The board cannot stand on the table via the corner 132 on which force is exerted. In the tilted position, the stand 115 and one side (e.g., 127) of the board contact the table (FIG. 3*d*). In some embodiments, the board may not need to contact the table and only the stand needs to contact the table in the tilted position. The board can be slanted without contacting the table. In some embodiments, the board can be tilted in a limited number of directions or other number of directions (e.g., 3, 5, etc.) depending the way the grooves are formed or the shape of the board. The grooves would preferably be directed or run in lines that allow the play pieces to slide down due to the tilt.

Figure 4B:
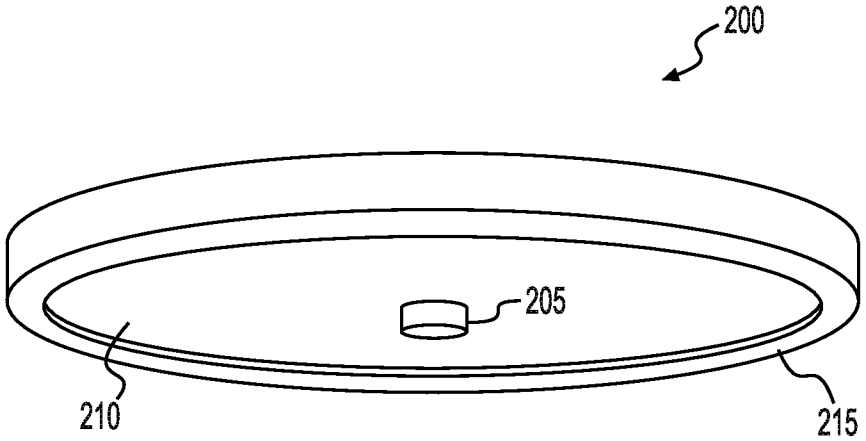
FIGS. 4*a*-4*b* depict an illustrative chip in accordance with some embodiments of the invention.
Figure 4A:
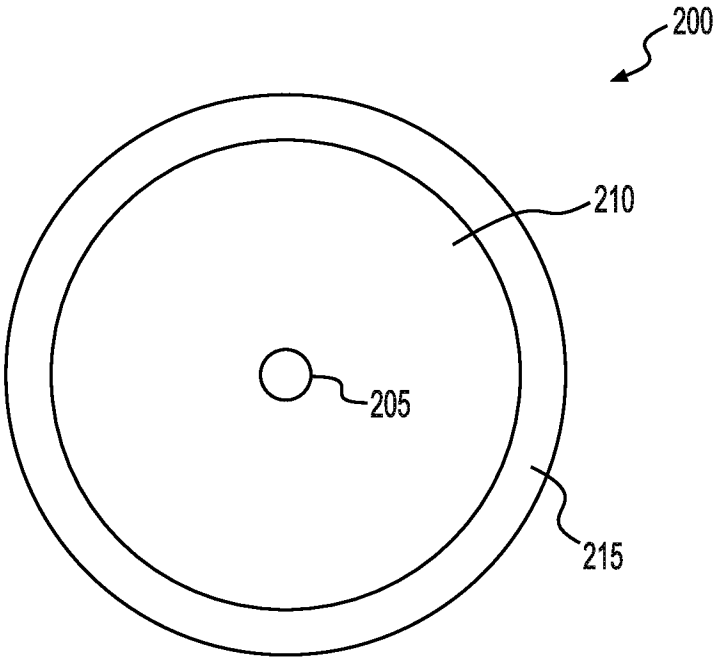
Figure 5:
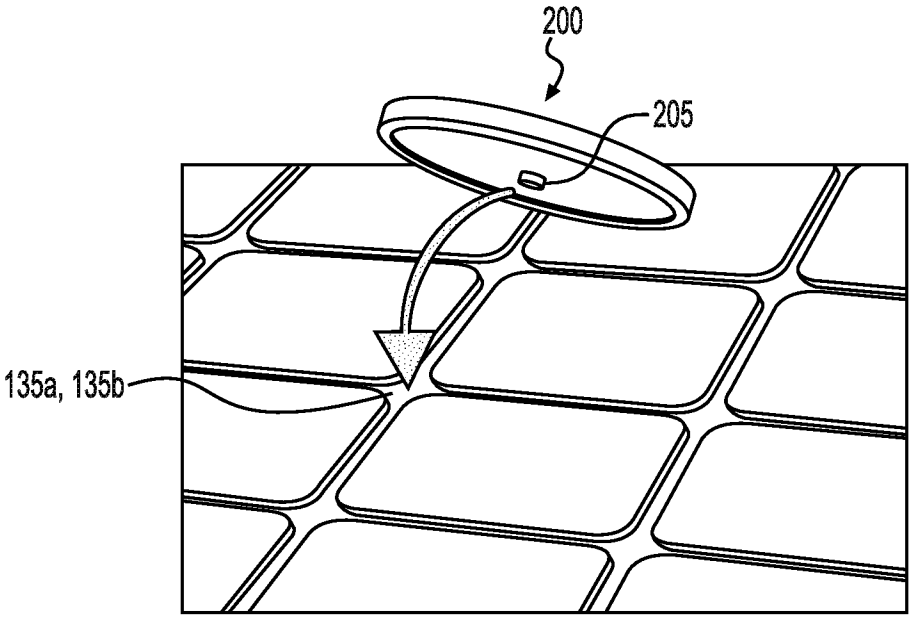
FIG. 5 depicts illustrative fitting of a chip into the groove on the board in accordance with some embodiments of the invention.

The top surface 150 (planar playing surface) of the board includes a structure or pattern adapted to receive the chips 110 (FIGS. 1*a*-1*b*). The structure of the surface includes horizontal and vertical rows of grooves 135*a*, 135*b* through which the chips 110 can move. The horizontal rows of grooves 135*a* and the vertical rows of grooves 135*b* have the same dimension to accommodate the chips 110 and be equally spaced. The grooves 135*a*, 135*b* have constant width and depth, thereby providing uniform channels of passage. The number of horizontal rows of grooves 135*a* and the number of vertical rows of grooves 135*b* may be the same or different. Each of the chips 110 includes a structure such as a pin or protrusion configured to be inserted into the groove. FIGS. 4*a*-4*b* depict an illustrative chip 200. The protrusion 205 may have a shape (e.g., round) corresponding to the shape of the chip 200 (e.g., round). The protrusion 205 may be positioned in the center of the chip 200 and may only be formed on one side of the chip 200 (e.g., bottom side 210 that faces the board). Other positions and structures of the protrusion are also contemplated. On the same side of the chip (e.g., bottom side that faces the board), that side may further include a wall 215 surrounding the protrusion 205. The height of the wall 215 and the height of the protrusion 205 may be different or the same as long as the protrusion 205 can be inserted into and move in the grooves 135*a*, 135*b* and is not interfered by the height of the wall 215. Referring to FIGS. 1*a*-1*b*, the chip 110 can move on the top surface via the pin 205 being guided by the grooves 135*a*, 135*b*. The grooves 135*a*, 135*b* and the pin 205 are configured in a manner such that the chip 110 can move from one location A on the board to another location B on the board when the board is tilted (due to the force of gravity). The chip 110 stays on the board 105 with the pin 205 in the groove 135*a*, 135*b* during movement (without falling off the board) (e.g., because of borders or guards 140 on the perimeter of the board). For example, when the board is tilted, a chip may slide from its location A downward to the side 145 of the board contacting the table (sliding from a higher position to a lower location). When there is a plurality of chips placed on the board, one or more of the plurality of chips may slide toward the side contacting the table (and is stopped from falling off by a mechanism such as border 140) and the chips 110 may contact each other. The grooves 135*a*, 135*b* and protrusion 205 have a dimension and/or structure that allow the chip 110 to move in response to board fitting. The chips 110 are free to move in longitudinal and latitudinal (X and Y) axes or multiple axes, without their movement being limited to one axis once the chip is placed on the board. The chips 110 are free to move in the grooves in response to the tilting movement (not in and out the board). Each chip only needs to be inserted into the grooves or placed on the board once for each game. They can be multidirectional. Chip movement stops when the chip contacts the border 140 or other chip(s) on the hoard, unless the board is further tilted in another direction. FIG. 5 depicts illustrative fitting of a chip into the groove on the board.

Referring back to FIG. 1, the board 105 includes a border 140 to prevent chips 110 from falling off the board when the board is tilted and chips can be placed in a location within the border. The border 140 may completely surround the board (or on all four sides of the square or rectangular board). The border 140 may be on the perimeter of the board. The border 140 may be formed without any entry or exiting points through which a chip can be inserted or slid into or removed from the board. The border 140 may have a height higher than the chip on the board, but other dimensions and structures that can prevent chips from falling off the board are also contemplated. The top surface 150 of the board is designed without a hole or other passage that allows a chip to fall downward or toward the table surface or stand (or drop into the stand or other component). In other words, the top surface 150 of the board is a continuous, solid, and/or unbroken surface. The top surface 150 extends continuously and in an unbroken manner from one side of the border (e.g., 141) to another side of the border (e.g., 142). The top surface 150 is a solid surface connected to four sides 141-144 of the board or border. The entire top surface 150 is a solid surface. The top surface 150 may be impermeable. It should be understood that this subject to the surface having grooves and related structures that form the groove while still be continuous, solid, unbroken, etc.

In some embodiments, the board can be without a stand. User could just lift and the opposing (e.g., straight) board edge would self-align the incline to match the direction or general direction of grooves. In other words, the top surface would be rotating about the far edge of the board due to the board being lifted tilted.

Figure 6C:
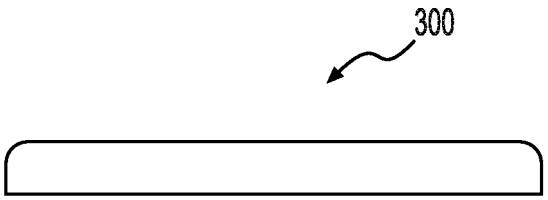
FIGS. 6*a*-6*c* depict an illustrative board without a stand in accordance with some embodiments of the invention.
Figure 6B:
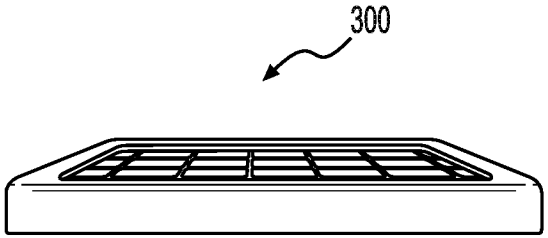
Figure 6A:
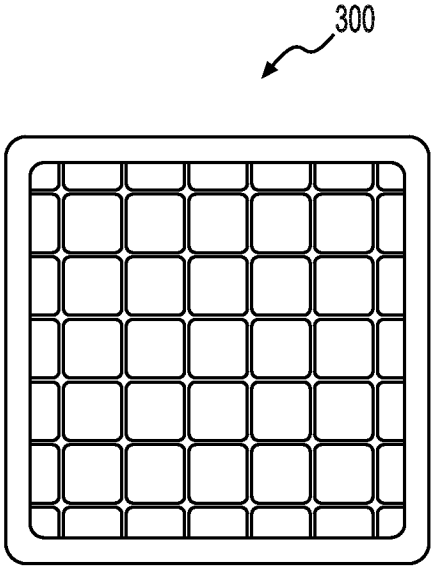

FIGS. 6*a*-6*c* depict an illustrative board 300 without a stand. FIG. 6*a* depicts a top view of the board 300. FIG. 6*a* also depicts the top surface 150 described above. FIG. 6*b* depicts a side view of the board 300 in which part of the top surface 150 is also shown (or an angled view of the board). FIG. 6*c* depicts another side view of the board in which only one side of the board 300 is shown (or a lateral view of the board).

Methods of playing the apparatus are also contemplated. A person unfolds the stand and places the apparatus on a table. A number of chips are distributed to each player. Players can take turns and place one or more chips on the board. Players can tilt the board to move the chips in a direction. Chips can be placed on the board before or after the board is tilted. The methods can involve putting some chips on the board before the board is tilted, tilting the board with the chips on it, and placing additional chips on the board after the board is tilted or removing one or more chips on the board after the board is tilted. Chip movement direction is determined by the tilting direction. The movement of chips is guided by the grooves. In one embodiment, chip movement is solely controlled by the tilting direction of the board, without using other additional devices such as magnet. After playing the board game, the stand can be folded to store the board.

A set of chips is also included in the kit or assembly and may be positioned in a bag that prevents the contents of the bag to be seen. Chips can be pulled from the bag and placed on the board. The tilting of the board and the resulting state of the chips (e.g., a particular sequence), after sliding, is used to determine whether chips should be removed from the board, based on the resulting arrangement. Chips on the board can also be constantly (or repeatedly or sequentially) tilted by players in different directions in order to reach a certain arrangement or pattern and win the game. Chips can be placed on the board before or after the board is tilted. Chips can also be removed from the board before or after the board is tilted. The chips can have a profile that does not interfere with other chips sliding down an adjacent groove. The chips can be printed with stickers on the top surface and/or be made with different physical shapes or colors to distinguish them. For example, the chips are either blue, red, yellow, or green only. Some chips may have one color and some chips may have another color resulting in different group of play pieces.

The stand or support is adapted to orient the tilting of the board in the desired directions. As shown in figures, the stand provides for the board to be tilted along the length and width (longitude/latitude) axis and potentially stay in the tilted (leaning) position but not adapted to do the same in the diagonal directions. As such, the board game apparatus can be adapted to be easily tilted in certain directions as a result of the board and stand be adapted to allow the apparatus to be set to be tilted in that direction (to have such predisposition or "programmed" to have predefined tilting orientations).

The grid grooves on the top surface of the board allow the chips to slide only in the two directions provided by the grooves.

The board, stand, and chips can be made of plastic, wood, metal, or other materials.

The apparatus, method, or board is adapted to have game pieces enter the field of play (the grooves) from the top, open face of the board (top surface 150). For example, it would not be adapted to allow a game piece to enter from the sides of the field of play (e.g., from border 140).

In preferred embodiments, the board or board game is not configured to be standing on its side to create a vertically standing board.

In preferred embodiments, the board game apparatus is configured to be stable, at equilibrium, on its stand (flat, even with game pieces are on the board). In some embodiments, the board game apparatus is adapted to stay in a tilted position when a player tilts the board in one preconfigured direction (e.g., because the weight of the board prevents the board from tilting back to a flat position when the user is not holding or supporting the tilted board). The weight of the play pieces can also (or in addition to) configure the board game apparatus to sit in a stable tilted position. Other forms of stands or surfaces are also contemplated in various embodiments. For example, the stand may be one that does not have preconfigured direction for tilting but allows the user to title in a desired direction and it can hold that direction without support from the user after it is tilted.

Figure 7B:
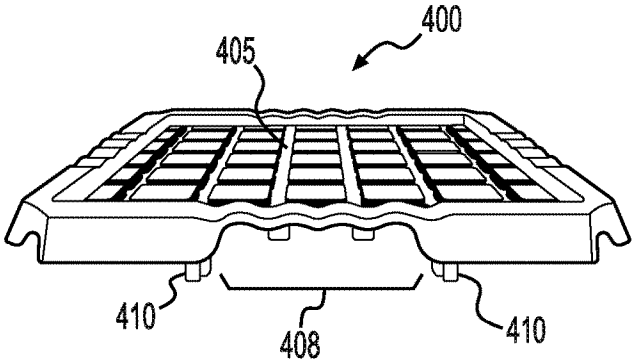
FIGS. 7*a*-7*c* depict a top view, a perspective view, and a side view of another illustrative board game apparatus, respectively, in accordance with some embodiments of the invention.
Figure 7C:
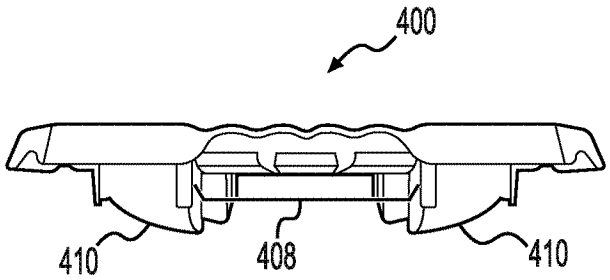
Figure 7A:
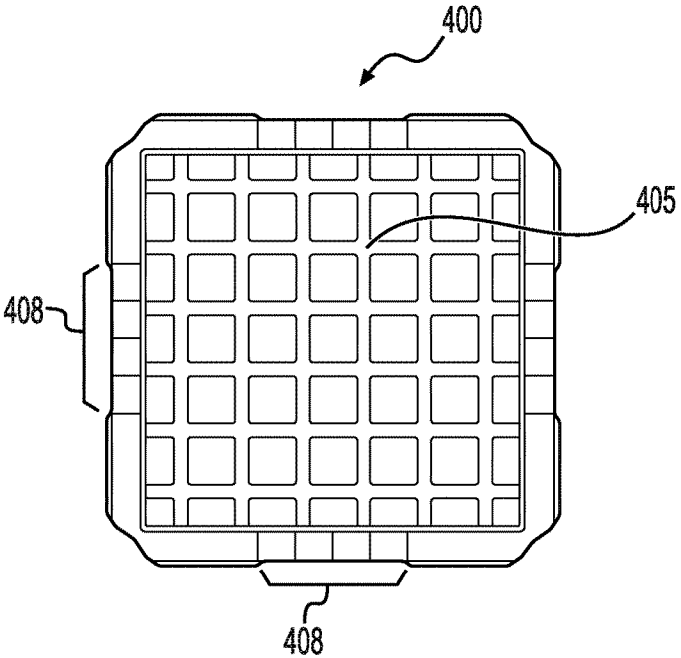
Figure 8:
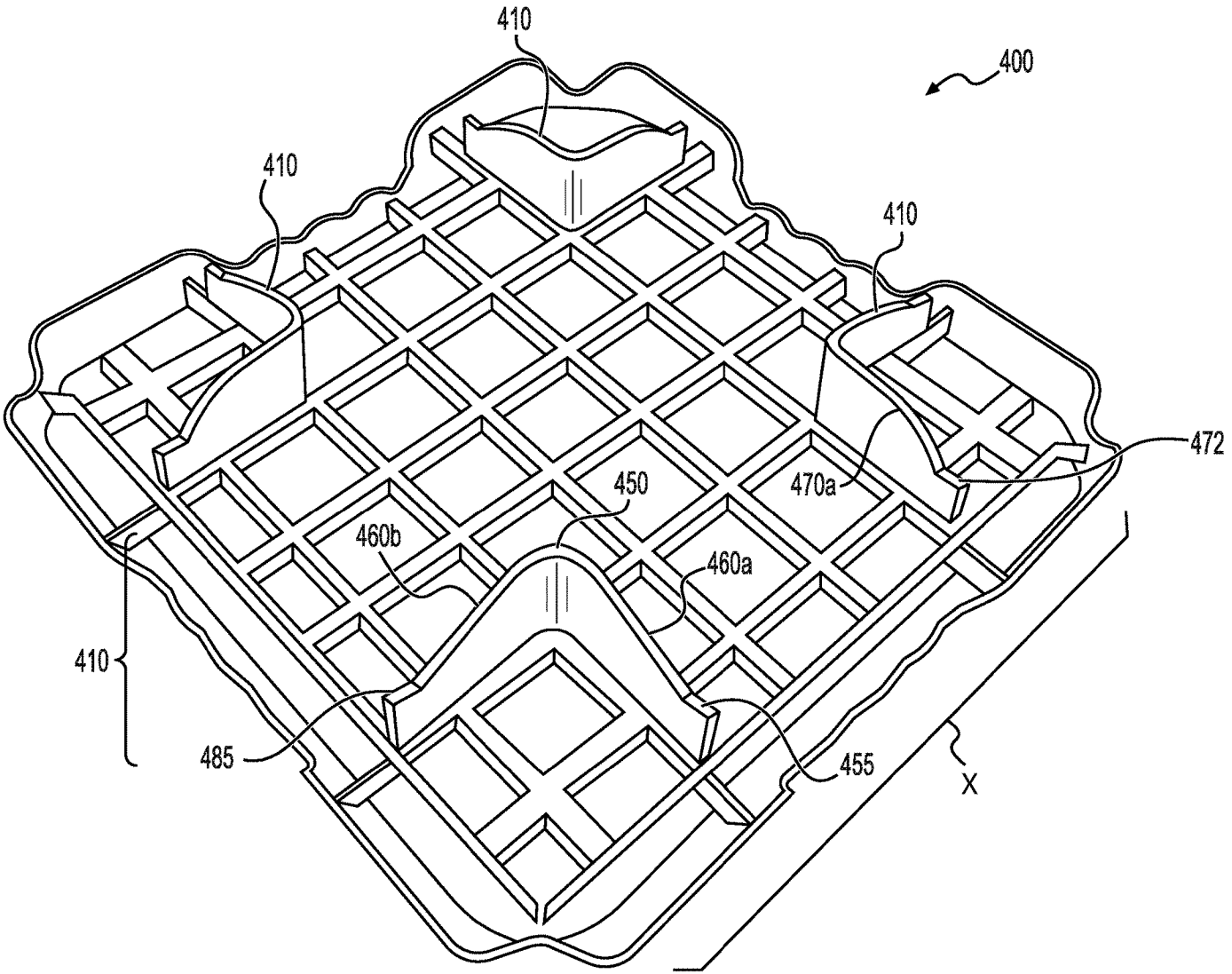
FIG. 8 depicts a bottom view of the board game apparatus in FIGS. 7*a*-7*c* in accordance with some embodiments of the invention.

FIGS. 7-9 depict another illustrative board game apparatus in accordance with some embodiments of the invention. The apparatus includes a board and a plurality of chips. FIGS. 7-8 depict an illustrative board 400 whereas FIG. 9 depicts an illustrative chip 500.

FIG. 7*a* depicts a top view of the board 400. FIG. 7*a* also depicts a top surface 405 (similar to the top surface 150 described above) and a board lifting area 408 of the board 400. FIG. 7*b* depicts a side view of the board 400 in which part of the top surface 405, part of the legs 410, and a board lifting area 408 are shown (or an angled view of the board). FIG. 7*c* depicts another side view of the board 400 in which part of the legs 410 and a board lifting area. 408 are shown (or a lateral view of the board). FIG. 8 depicts a bottom view of the board 400 in which the legs 410 are shown. The board 400 has a structure similar to the board 105 described above, except that the board 400 includes multiple legs 410 and a board lifting area 408. The multiple legs 410, collectively, may also be referred to as a stand or a stand provided in the form of multiple legs. Therefore, the description above regarding the stand 115 may also be applicable to the multiple legs 408 (e.g., support the board above the table or other surface, can be foldable, etc.). The board 400 also operates or can be played in manners similar to the board 105 or apparatus 100.

In one embodiment, the board 400 includes four legs 410. Referring to FIG. 8, the board 400 has a leg 410 for each corner of the board. The leg 410 may be positioned directly under the corner or in an area close to the corner. In some embodiments, the legs can be moved closer to the center (and modified if necessary) as long as the board can be tilted as described. The board 400 may include a number of legs (e.g., 4 legs) corresponding to the number of corners (e.g., 4 corners) the board has. The board 400 may also include a number of legs different from the number of corners the board 400 has. In some embodiments, the legs can be disengaged from and reengaged with the board 400 (removable legs).

Figure 10A:
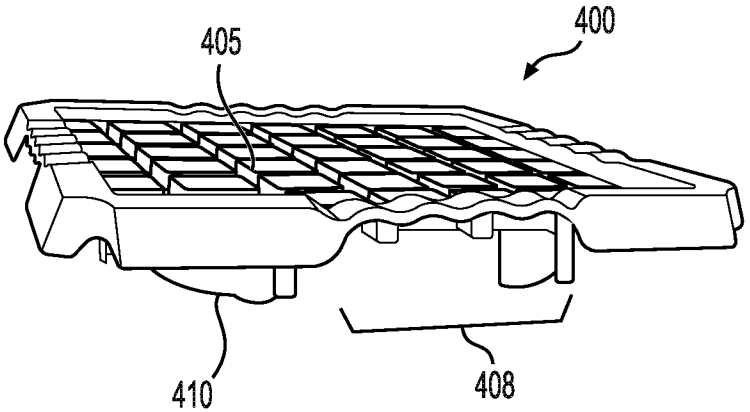
Figure 11C:
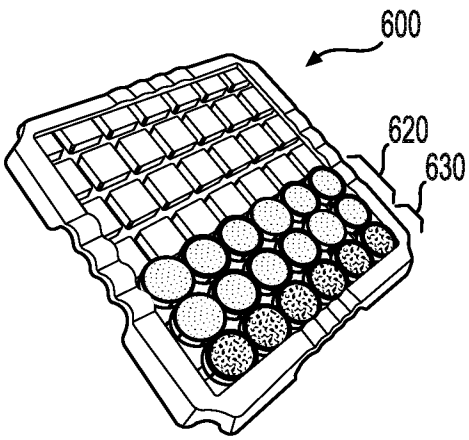
FIGS. 11*a*-11*c* another illustrative tilting of the board and illustrative chip movement due to the tilt in accordance with some embodiments of the invention.
Figure 11B:
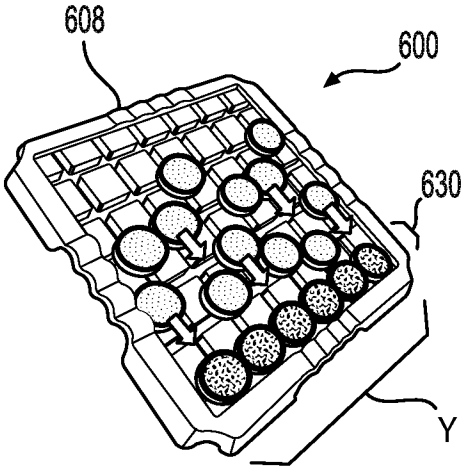

The leg 410 has a structure that enables the board to move between a first position (e.g., stable, horizontal, or flat position, see FIG. 7, FIG. 10*a*, and FIG. 11*a*) and a second position (e.g., tilted position, see FIGS. 11*b*-11*c*). In one embodiment, the leg 410 includes a first region 450 configured to contact the table or other surface and support the board when the board is in the first position. The leg 410 includes a second region 455 configured to contact table or other surface when the board is in the second position. In the first position, only the first region 450 contacts the table (not the second region 455). In the second position, only the second region 455 contacts the table (not the first region 450). The leg 410 includes a first side or slope (sloped or slanted side) 460*a* extending from the first region 450 to the second region 455. From the bottom view of the board, the slope 460*a* extends from the first region 450 downward toward the board. From the top view of the board or a side view of the board (FIG. 7*c*), the slope 460*a* extends from the first region 450 upward toward the board. The slope 460 may be a straight, linear (diagonal line) or curved or has a curvature. The leg 410 includes another side or slope (sloped or slanted side) 460*b* that is similar to the first slope 460*a* The second slope 460*a* extends from the first region 450 to another region 455. The first side 460*a* and the second side 406*b* are perpendicularly or are substantially perpendicular.

The legs 410 define a number of second positions or tilted positions. For example, when the board 400 is a rectangle or square, the legs 410 define four titled positions with each position corresponding to each side of the rectangle or square.

When the board 400 is placed on the table, the board is supported by the first region 450 of each leg 410 and lies flat on the table. When an individual pushes one side of the board toward the table, the slope of the leg starts to contact the table until it reaches the second region. The first region may be lifted above the table while the slope is contacting the table surface and the contact (the contact between the leg and the table surface) is moving toward the second region. When the contact reaches the second region, the first region may no longer be contacting the table surface. For example, when a person pushes side X of the board (FIG. 8) downward or toward the table (e.g., flipping the board in FIG. 8 over and pushing side X downward), the leg starts to contact the table surface via the slope 460*a* until the contact reaches the second region 455. In one embodiment, the movement between the flat position and the tilted position relies on two or multiple slopes. For instance, in the above example, the movement may depend on slope 460*a* of one leg and slope 470*a* of another leg (parallel to slope 460*a*) and continues until they reach their respective second region 455, 472. Slope 460*a* and slope 470*s* simultaneously contact the table surface during the movement and the contact reach second regions 455, 472 at the same time.

When the board is in the tilted position, the board stands on the table surface via second regions (e.g., 455, 472). In one embodiment, the second region includes a structure that requires applying external force to the board to hold the board in the tilted position. The second regions are configured such that they cannot hold the board in the tilted position by themselves or without applying external force (or they can only hold the board momentarily such as 1 to 2 seconds and then the board returns to its flat position). For example, continuing with the previous example, after the person pushes side X of the board downward and side X contacts the table surface, the board or the second regions require the person to keep holding or applying pressure to side X in order to keep the board in the tilted position. When the person stops holding side X, the board tilts back to the first position and stands on the table surface via the first regions of the legs. In another embodiment, the second region may include a structure that does not require applying external force to the board to hold the board in the tilted position. The second regions are configured such that they can hold the board in the tilted position by themselves or without applying external force, and support the board when the board is in the tilted position.

The stand (whether it is in the form of 115 in FIG. 2 or 410 in FIG. 8) and the board are configured to provide the apparatus with predisposition tilting directions (e.g., a predefined number of directions or orientations, as opposed to being able to tilt, rotate, or otherwise move in 360° degrees). Other configurations, structures, and arrangements (of the stand alone, of the board alone, or of the combination of the stand and board) that can provide similar predisposition tilting directions are also contemplated.

The board 400 also includes a board lifting area 408 (FIG. 7). The board 400 may include a board lifting area 408 for each side of the board, or each side or direction that the board can be lifted or tilted. The board 400 may include a number of board lifting areas equal to the number of directions or orientations that the board can be tilted. For example, in FIG. 7, the board 400 can be tilted in four different directions and the board includes a board lifting area for tilting the board in each direction. Board lifting areas also provide indication to players that the board can be lifted from here (e.g., they have a structure showing that they can be grabbed by hand, such as concave/convex structures or curvatures that correspond to the shapes of fingers). Although the board includes board lifting areas, the board does not necessarily need to be lifted or tilted using the board lifting area. As discussed in earlier examples, the board can also be tilted by pushing a particular side of the board downward toward the table surface. A player may prefer using a board lifting area to tilt the board while another player may prefer pushing a side of the board to tilt the board. The board lifting area allows a player to lift the side associated with the board lifting area (or the side in which the board lifting area is built into) away from the table surface. The lifting also causes the side opposite to the side being lifted to move downward toward the table surface. The side opposite to the side being lifted may contact the table surface after the board is lifted. The board, the legs, and the board lifting area are configured to provide tilting angles that can move chips to different locations without chips falling off the board (with assistance from the border).

When a person lifts the board through a board lifting area, the board similarly relies on the slopes and the second regions to perform the tilting movement as discussed earlier. In particular, the board relies on the slopes and the second regions of the two legs opposite to the side being lifted. After board is lifted, the board may require the person to keep lifting or holding the board in order to keep the board in the tilted position as the second regions cannot hold the board in the tilted position on their own. In some embodiments, the board may not require the person to continue holding if the second regions can support the board in the tilted position by themselves or without external force.

The board lifting area may be formed as part of the border of the board that keeps the chips in the board. In other words, the board lifting area may be pail of the border and prevent the chips from falling out the board. The board lifting area does not make or is not an area allowing chips easier to fall off or exit the board.

Figure 9B:
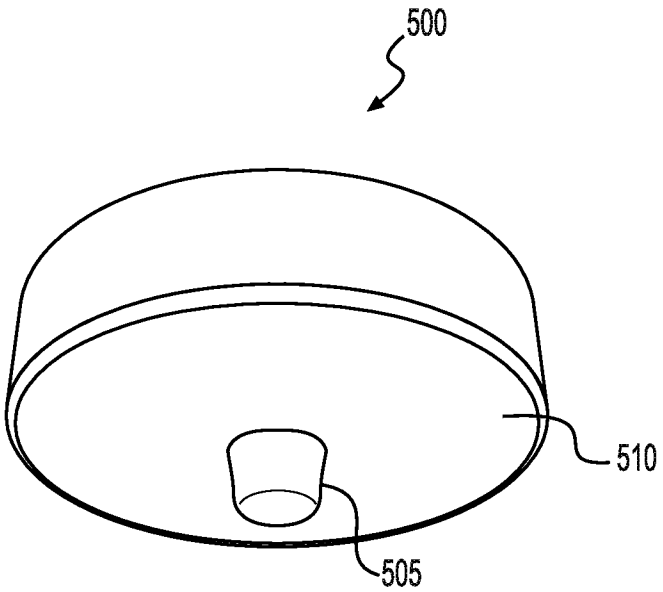
FIGS. 9*a*-9*b* depict another illustrative chip in accordance with some embodiments of the invention.
Figure 9A:
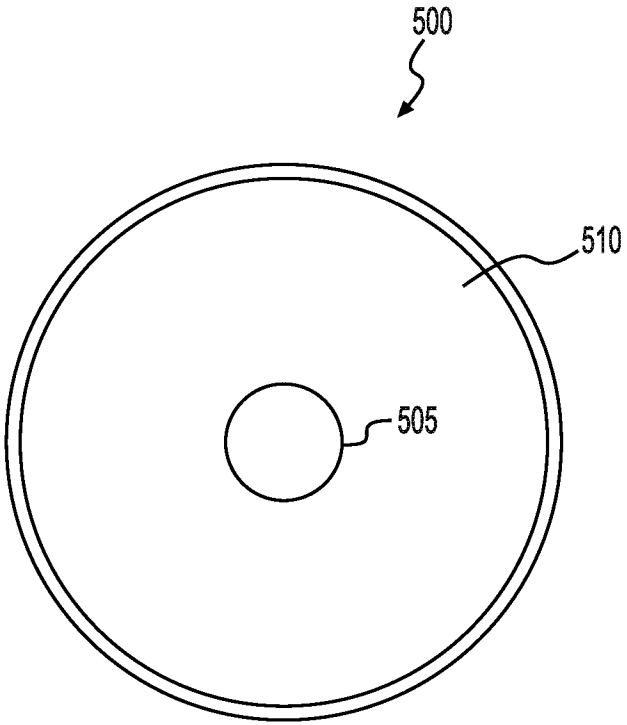

FIGS. 9*a*-9*b* depict an illustrative chip 500. The chip 500 includes a structure such as a pin or protrusion 505 configured to be inserted into the groove on the board. The pin 505 may have a shape (e.g., round) corresponding to the shape of the chip 505 (e.g., round). The pin 505 may be positioned in the center of the chip 500 and may only be formed on one side of the chip 500 (e.g., bottom side 510 that faces the board). Other positions and structures of the protrusion are also contemplated.

Figure 10B:
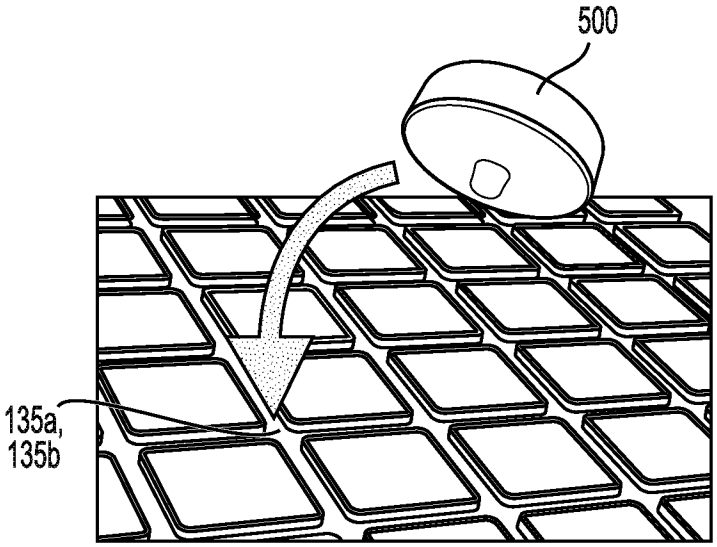
FIG. 10*b* depicts another illustrative fitting of a chip into the groove on the board tilt in accordance with some embodiments of the invention.

FIG. 10*a* depicts another side view of the board 400 in which part of the top surface 405, part of the legs 410, and a board lifting area 408 are also shown (or another angled view of the board). FIG. 10*b* depicts another illustrative fitting of a chip 500 into the groove 135*a*, 135*b* on the board 400.

Figure 11A:
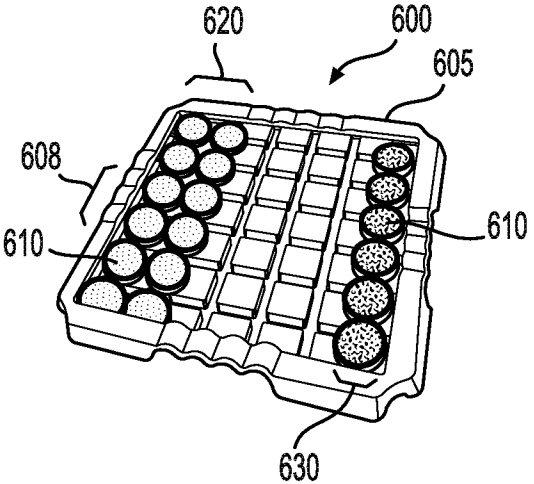

FIG. 11*a* depicts an illustrative board game apparatus 600 placed on a flat or playing surface (e.g., table surface). FIG. 11*a* shows the apparatus 600 in the first or horizontal position (before being tilted). The apparatus 600 includes a board 605 and a plurality of chips 610. The board 605 includes a plurality of board lifting areas 608. FIGS. 11*b*-11*c* depict an illustrative tilted board 600 and illustrative chip movement due to the tilt. In FIG. 11*b*, a player might have either lifted the board 600 from the board lifting area 608 or pushed side Y of the board 600 toward the playing surface (the board in FIG. 3 may also be lifted, instead of being pushed on one side, to tilt the board even though the board does not have a board lifting area). Chips 620 move from their starting locations toward chips 630 (slide down toward 630 via the grooves) as the board is being tilted in the manner shown in FIG. 11*b*. The border and the groove and the pin of the chip) keep the chips on the board 600 without falling off the board. FIG. 11*c* shows the final locations of all the chips 620, 630 after the movement. After the player releases the board lifting area 608 or side Y, the board 600 returns to the first or horizontal position with the chips staying in the same locations shown in FIG. 11*c* (this also applies the chips in FIGS. 1*a*-1*b* after the board is tilted and released). The description of FIGS. 1*a*-1*b* is also applicable to FIGS. 11*a*-11*c* and will not be repeated for the sake of brevity.

The above are illustrative of embodiments of the present invention.

Variations, modifications, and generalizations are contemplated and understood to be part of the invention in view of the present disclosure.

It should be understood that combinations of described features or steps are contemplated even if they are not directly described together or not in the same context.

The words "may" and "can" are used in the present description to indicate that this is one embodiment but the description should not be understood to be the only embodiment.

It is intended that the specification and examples be considered as exemplary only, with a true scope being indicated by the claims and their equivalents.

The invention claimed is:

1. A board apparatus comprising:

a rectangular board having a top and bottom surface, wherein the top surface includes horizontal and vertical rows of grooves;

a plurality of chips including a protrusion configured to fit in the grooves, wherein the chips are configured to move in the grooves via the protrusion and in directions determined by the grooves; and a plurality of legs located at a distance apart attached to the bottom surface and configured to support the board on a flat surface in a horizontal position;

wherein the plurality of legs is configured to make the board movable between the horizontal position and a number of tilted positions defined by the plurality of legs, and the board in each tilted position allows chips to slide on the board due to force of gravity;

wherein the plurality of legs defines four tilted positions, the board has four sides and is configured to move to each tilted position by applying force to or lifting a corresponding side of the four sides, and, in each tilted position, the board contacts the flat surface;

wherein the plurality of legs comprises four legs, one leg positioned directly under each corner of the board, each leg of the plurality having a curvature that defines one of the tilted positions, and includes:

a first region to support the board on the flat surface in the horizontal position;

a second region to support the board in the tilted position; and wherein the curvature extends upwards from the first region to the second region;

wherein the top surface is formed without a hole that allows chips on the board to fall toward the flat surface or into the stand.

2. The apparatus of claim 1, wherein each leg has a structure requiring force being applied to the board in order to hold the board in the tilted position.

3. The apparatus of claim 1, wherein the board further includes a border that prevents chips from falling off the top surface and that is formed without entry points through which chips can be inserted.

4. The apparatus of claim 3, wherein the border includes a board lifting area allowing a player to move the board from the horizontal position to one of the tilted positions.

5. The apparatus of claim 1, wherein each of the legs is positioned directly under each corner of the board or in an area close to each corner of the board.

6. The apparatus of claim 1, wherein the second region has a structure requiring force being applied to the board in order to hold the board in the tilted position.

* * * * *